US006624723B2

(12) United States Patent
Wang

(10) Patent No.: US 6,624,723 B2
(45) Date of Patent: Sep. 23, 2003

(54) MULTI-CHANNEL FREQUENCY MULTIPLEXER WITH SMALL DIMENSION

(75) Inventor: Chi Wang, Middletown, NJ (US)

(73) Assignee: Radio Frequency Systems, Inc., Meriden, CT (US)

( * ) Notice: Subject to any disclaimer, the term of this patent is extended or adjusted under 35 U.S.C. 154(b) by 6 days.

(21) Appl. No.: 09/901,059

(22) Filed: Jul. 10, 2001

(65) Prior Publication Data

US 2003/0011444 A1 Jan. 16, 2003

(51) Int. Cl.[7] ..... H01P 1/213
(52) U.S. Cl. ..... 333/134; 333/203; 333/230
(58) Field of Search ..... 333/134, 203, 333/202, 206, 230, 129, 132

(56) References Cited

U.S. PATENT DOCUMENTS

| | | | | |
|---|---|---|---|---|
| 4,216,448 A | * | 8/1980 | Kasuga et al. | 333/203 |
| 4,513,264 A | | 4/1985 | Dorey et al. | 333/212 |
| 4,562,409 A | | 12/1985 | Saito et al. | 330/286 |
| 4,593,460 A | | 6/1986 | Gannon et al. | 29/602 R |
| 4,881,051 A | | 11/1989 | Tang et al. | 333/208 |
| 4,890,078 A | * | 12/1989 | Radcliffe | 333/134 |
| 5,428,325 A | * | 6/1995 | Jachowski et al. | 333/203 |
| 5,446,729 A | * | 8/1995 | Jachowski | 370/297 |
| 5,751,199 A | * | 5/1998 | Shiau et al. | 333/134 |
| 5,894,250 A | * | 4/1999 | Ravaska et al. | 333/134 |
| 6,025,764 A | * | 2/2000 | Pelz et al. | 333/202 |
| 6,392,506 B2 | * | 5/2002 | Wulff | 333/134 |

FOREIGN PATENT DOCUMENTS

| | | | |
|---|---|---|---|
| CA | 1251-835 A | 3/1989 | H03H/9/70 |
| EP | 0 432 729 A2 | 6/1991 | H01P/1/21 |
| JP | 3-191619 | 8/1991 | H04B/1/03 |

* cited by examiner

*Primary Examiner*—Robert Pascal
*Assistant Examiner*—Dean Takaoka
(74) *Attorney, Agent, or Firm*—Sughrue Mion, PLLC

(57) ABSTRACT

A multi-channel multiplexer has a substantially square shape and includes an N×N matrix with a common resonator. A plurality of input/output ports are connected to a common input/output port via respective resonators of the N×N matrix and the common resonator. The multiplexer provides a compact size, with balanced insertion losses and simple configuration to minimize phase difference of inter-resonator transitions.

34 Claims, 5 Drawing Sheets

MULTI-CHANNEL FREQUENCY MULTIPLEXER WITH SMALL DIMENSION

FIELD OF INVENTION

The present invention relates to a frequency combiner with a plurality of air-filled resonators connected to corresponding input ports. Each input port and corresponding resonator is connected to a common output port via a common resonator. The plurality of resonators are arranged such that they provide frequency selection and combining functions with a small dimension. The use of the common resonator mitigates phase differences of inter-resonator connections and minimizes insertion loss. The invention also relates to a frequency divider, whereby signals having different frequencies are provided to a common input port and common resonator. A plurality of resonating cavities, which resonate at different frequencies, are connected to the common resonator to separate signals of different frequencies to respective output ports.

DESCRIPTION OF RELATED ART

In communications applications requiring transmission and/or reception over a plurality of closely-spaced frequency channels, it is preferable to combine the frequencies for transmission via a common antenna or other broadcast facility. This requires combining frequencies within the allotted bandwidth, while preventing interference between channels. Using a plurality of resonators permits sharing of a physical facility, such as an antenna, for broadcast. However, if multiple channels are served by the same facility, space constraints as well as cost constraints become important. For example, in a code-division multiple access (CDMA) system, two resonators are usually required per channel to achieve the required performance. The dual resonator configuration is commonly used for a 1–25 MHz bandwidth channel with a 2.5 MHz channel spacing. Larger bandwidth requirements require more resonators per channel. Known resonator arrays for combining multiple (N) channels for CDMA systems use an N×2 matrix. For instance, a known four-channel combiner uses a 4×2 arrangement of resonators. This conventional resonator suffers from at least two deficiencies. First, the alignment of four resonators in a row provides a bulky arrangement that makes the combiner difficult to accommodate in a small space having width limitations. A dielectric resonator may be used to reduce the resonator size. However, use of the dielectric increases the cost of the frequency combiner and also introduces the mechanical complexity. Second, the conventional 4×2 arrangement requires phase loop control to maintain a zero (or 180°) phase difference during inter-resonator transitions among CDMA channel signals. This complicates the design of the resonator matrix. The present invention obviates the above deficiencies by providing an N×N matrix ($N \geqq 3$), including a central common resonator cavity.

SUMMARY OF INVENTION

A multi-channel frequency multiplexer having combiner and divider functions is disclosed which minimizes phase difference, minimizes the size of the multiplexer and balances the insertion loss. As a combiner, the structure includes an N×N matrix of frequency resonators, with a plurality of the resonators being provided with channel input ports. The resonators are interconnected with a common resonator, which in turn, is coupled to a common output port.

The structure may also be used as a frequency divider having improved performance characteristics.

BRIEF DESCRIPTION OF DRAWINGS

A preferred embodiment of the invention will be described below with reference to the following drawings where.

DESCRIPTION OF PREFERRED EMBODIMENT

Figure 1:
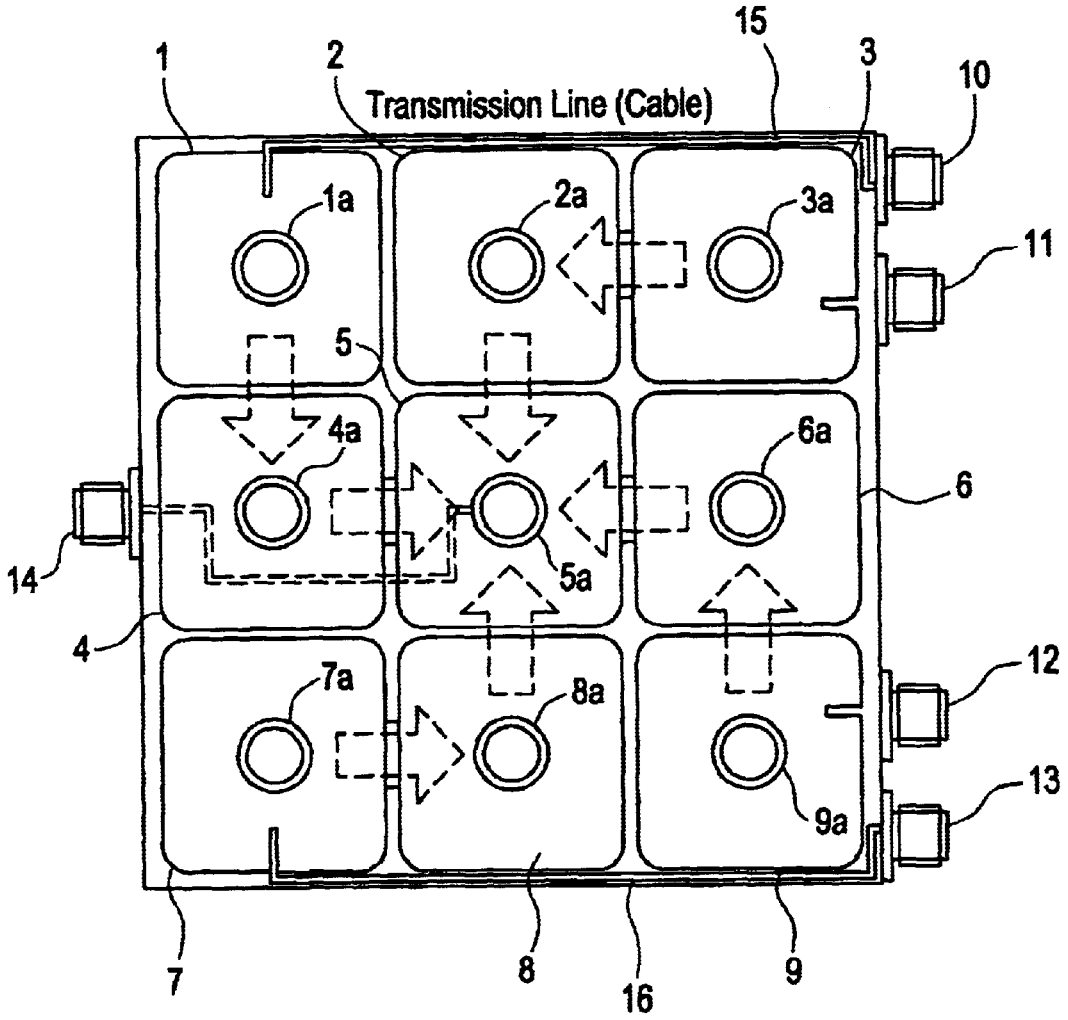
FIG. 1 illustrates a top view of a frequency combiner according to a preferred embodiment of the present invention.

FIG. 1 illustrates a four channel frequency combiner using 3×3 matrix of air-filled resonators. The central resonator 5 comprises the common resonator. Each of the peripheral resonators 1–4 and 6–9 resonate at a frequency depending on the position of the tuning pins 1*a*–9*a* of the respective resonators. A preferred embodiment of the invention may be applied to cellular communications in the frequency range of 869–894 MHz using a CDMA system. However, the invention is not limited to this field of application. For a CDMA application, two of the resonators define a channel. Therefore, the 3×3 matrix supports four different channels. The channel inputs are provided at ports 10–13. The channels are combined in the common resonator 5 and provided to a common output port 14.

In particular, a first frequency channel is provided at input port 10 and is first selected in cavity 1 and then in cavity 4 prior to combination with other frequency channels in the common combiner 5. The frequency signal is conveyed from the input port 10 to the cavity resonator 1 by the transmission line 15. A second frequency channel is provided at input port 11 and is first selected in cavity 3 and then in cavity 2 prior to combination with other frequency signals in the combiner 5. The third frequency channel is provided at input port 12 and is first selected in resonator 9 and then in resonator 6. Finally, the fourth frequency signal is provided to the port 13 and is selected first in the resonator 7 and then the resonator 8 prior to entering the common resonator 5. The frequency signal is conveyed from the input port 13 to the cavity resonator 7 by a transmission line 16. The described arrangement permits channel multiplexing using a simple and space-efficient arrangement of air-filled resonators.

It has further been observed that a critical phasing transmission line is not needed in the multi-channel multiplexer described above. As a result, microwave channel frequencies can be combined or divided efficiently over a broad bandwidth.

The layout keeps the footprint of the CDMA combiner to a minimum, with the shape of the four channel combiner being essentially square. The common resonator has four side walls and is placed at the center of the combiner. Each of the four channels has two resonators. The first resonator of each channel is placed at a corresponding corner of the combiner, while the second resonator of each channel is placed next to a corresponding side wall of the common resonator. As a result, the size of the four channel combiner is minimized.

All four frequency channels have approximately the same insertion loss. The insertion loss of the lowest and the highest frequency channels is lower than the insertion loss for the two middle frequency channels when the channel frequencies have small frequency separation. To balance out the insertion loss, the input ports for the two middle frequency channels are placed closer to their corresponding first resonators, than the input ports for the highest and the lowest frequency channels. In the embodiment described in FIG. 1, the high and low frequency channels may be provided through either the resonators 1 and 4 or over the resonators 7 and 8. The central frequencies are provided through resonators 3 and 2 and resonators 6 and 9. For the middle frequencies, placing the first resonator closer to the input port reduces the length of transmission line needed, thereby reducing insertion loss for the two middle frequency channels. In a preferred embodiment, no transmission line is required for the middle frequencies. Correct selection of transmission line length results in similar insertion loss for all four frequency channels.

More generally, the invention comprises a tunable microwave multiplexer. Within the multiplexer is a plurality of channel filters comprising at least one resonator for filtering microwave and RF signals. The channel filters are coupled to a combining/dividing mechanism. The combining/dividing mechanism comprises a common port and a common resonator coupled to the common port.

The tunable multiplexer operates in the following manner. A signal comprising a plurality of microwave signal frequencies is input at a common port 14. The signal will pass through the common resonator 5. A signal frequency from one of the plurality of microwave signals will couple into a filter of the combined resonators (1–4), (2–3), (6–9) or (7–8) if the passband of the filter is tuned to the frequency of the microwave signal. On the other hand, if the passband of the filter is tuned to a different frequency, then the resonator filter will reject the microwave signal. In this manner, the plurality of microwave signals will be separated.

The tunable multiplexer can also be used to combine signals of different frequencies. Signals of different frequencies are input via transmission ports to a channel filter that will pass its respective frequency. The signals will be combined into one signal comprising these different signal frequencies in the common resonator. The composite signal is then output through the common port.

Figure 2:
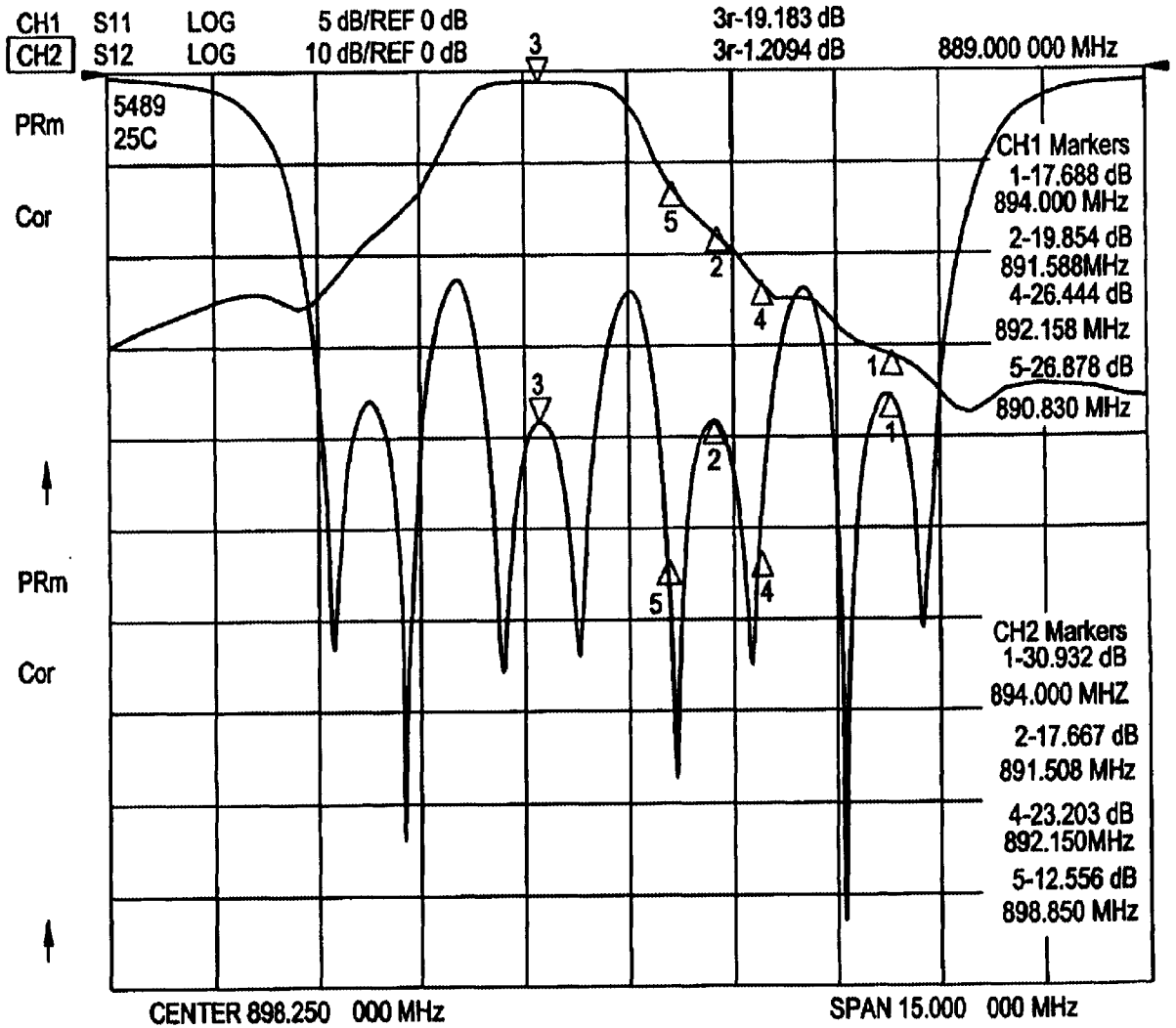
FIG. 2 illustrates the frequency characteristics of the frequency combiner/divider of a preferred embodiment of the present invention.

FIG. 2 shows the frequency characteristics for channel 2 in the frequency combiner/divider. The top curve shows the passband characteristics of the filter. The passband shows only a 1.21 dB loss. The bottom curve shows the return loss of four different channels. The amount of loss is very low.

Figure 3:
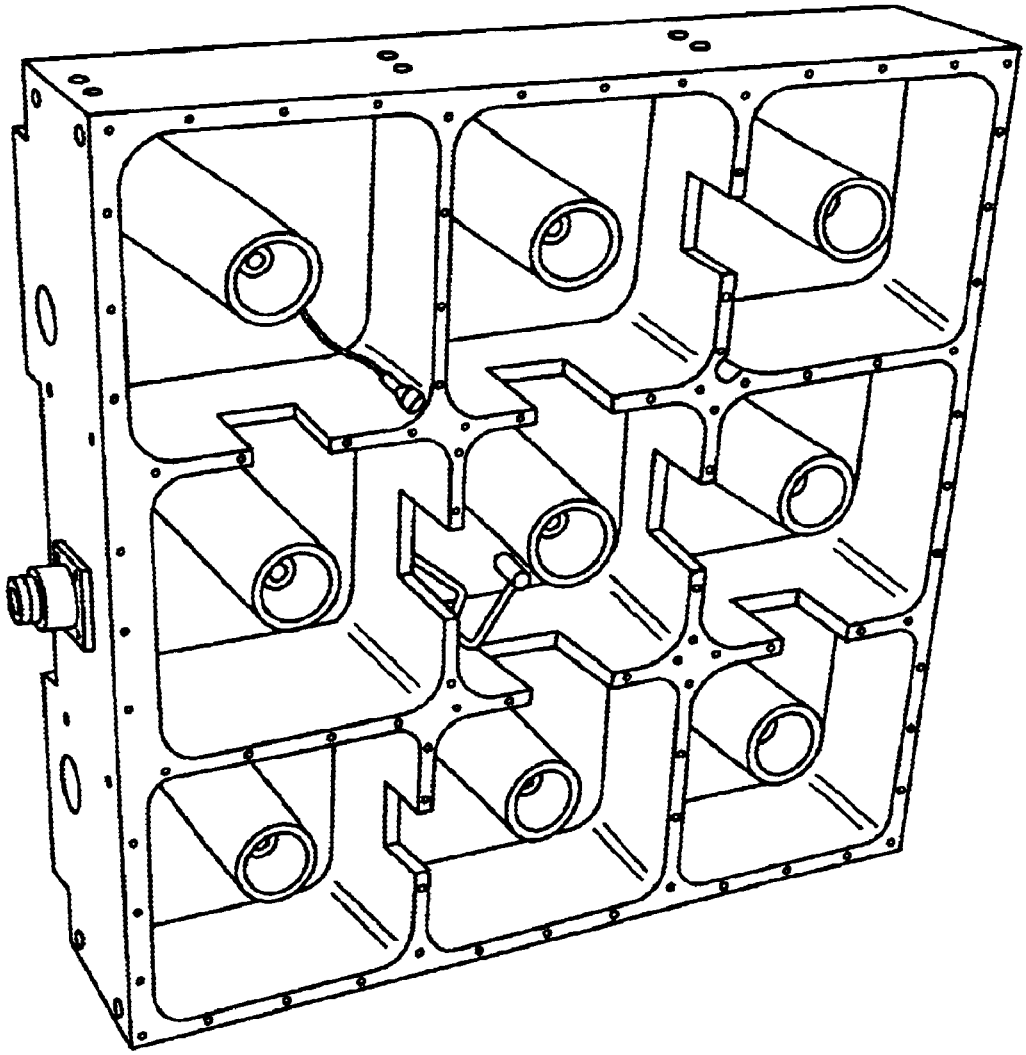
FIG. 3 is a plan view of the frequency multiplexer.

FIG. 3 is a plan view of the combiner/divider according to the invention.

Figure 4:
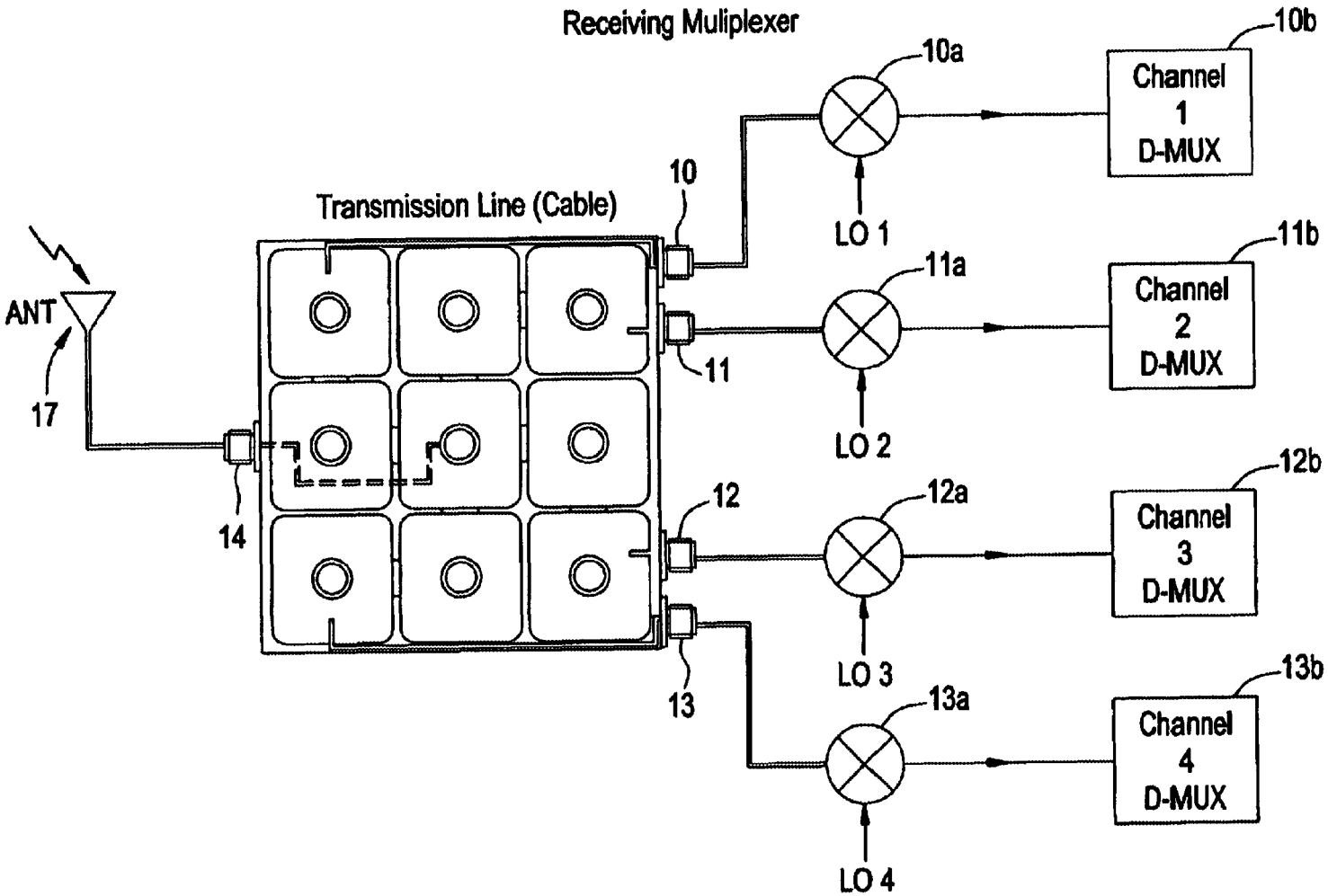
FIG. 4 is a schematic view of a receiving frequency multiplexer according to a preferred embodiment of the invention.
Figure 5:
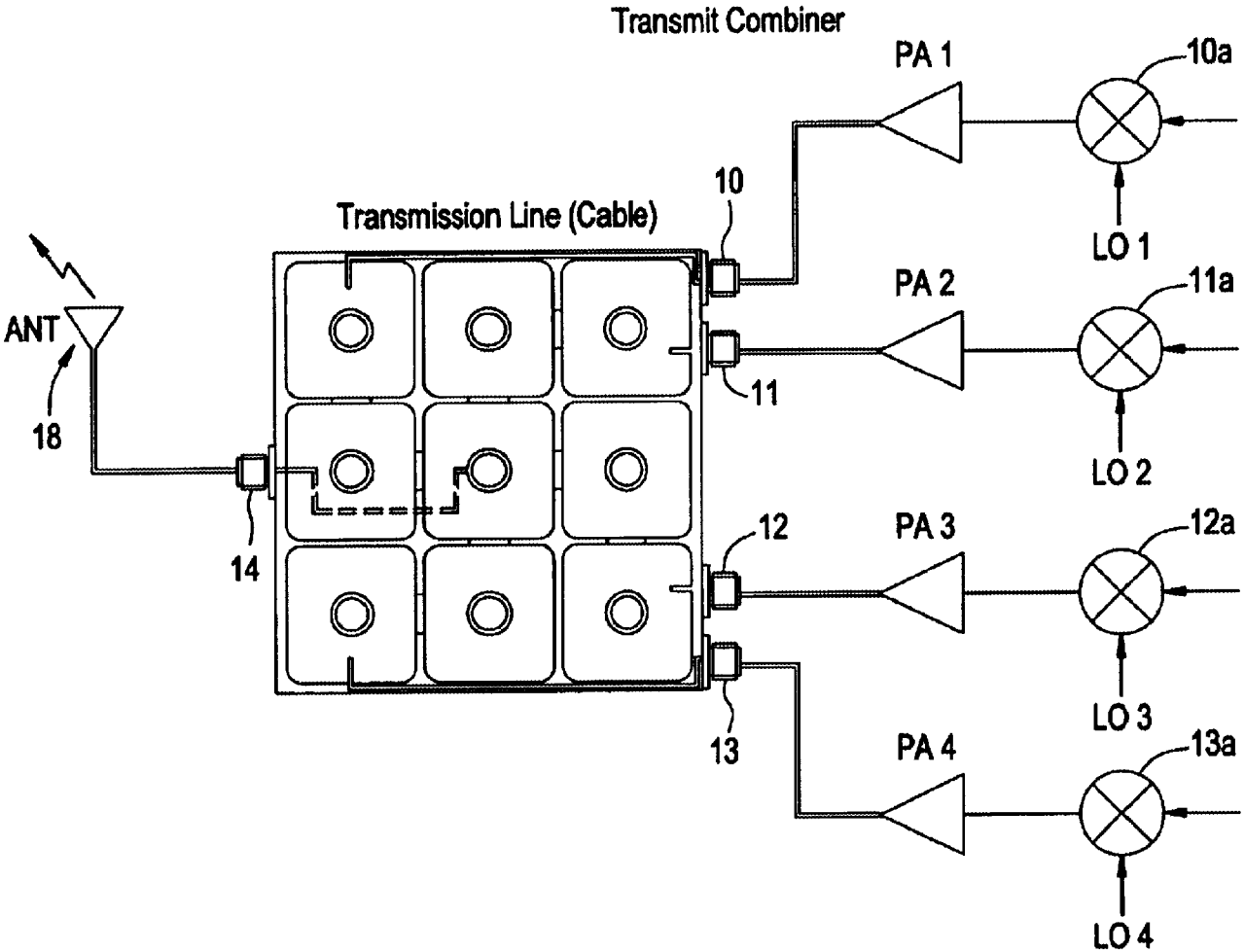
FIG. 5 is a schematic view of a transmit frequency combiner according to a preferred embodiment of the invention

FIG. 4 illustrates a receiving frequency multiplexer according to an embodiment of the present invention used in a communication system. The reference numerals of the multiplexer correspond to those previously set forth in the discussion of FIG. 1. A receiving antenna 17 receives combined channel signals, which are selectively separated from each in the manner as discussed above. The separated channels are provided to RF converters 10*a*–13*a*. Baseband signals for channels 1–4 are respectively demultiplexed in demultiplexers 10*b*–13*b*. Though FIG. 4 shows a receiver side configuration, the apparatus of the present invention can also be used to combine frequencies is prior to transmission. The transmitter configuration is shown in FIG. 5, where reference numeral 18 corresponds to a transmit antenna.

Though preferred embodiments of the invention have been set forth above, one skilled in the art would understand that various modifications can be made thereto that do not depart from the scope or spirit of the invention.

What is claimed is:

1. A multi-channel frequency multiplexer comprising:

an N×N matrix of air-filled resonators, where N≧3, said N×N matrix having a substantially square configuration, said frequency multiplexer having a common resonator shared by multiple channels disposed at a center position of the N×N matrix.

2. The multiplexer of claim 1, wherein the center position of the matrix comprises a position disposed away from edge portions of the matrix.

3. The frequency multiplexer of claim 1, further comprising a plurality of input/output ports connected to respective resonators of said N×N matrix, said input/output ports further connected to the common resonator through the respective resonators.

4. The frequency multiplexer of claim 3, wherein the common resonator is connected to a common input/output port.

5. The frequency multiplexer of claim 4, wherein each of the plurality of input/output ports is connected to the common resonator through two respective resonators of said N×N matrix.

6. The frequency multiplexer of claim 5, wherein a first one of the respective resonators for each input/output port is disposed along one side wall of the common resonator.

7. The frequency multiplexer of claim 6, wherein a second one of the two respective resonators for each input/output port is provided adjacent to the first one of the respective resonators.

8. The frequency multiplexer of claim 7, wherein the second one of the two respective resonators is provided at a corner of the N×N matrix.

9. The frequency multiplexer of claim 8, wherein a plurality of frequency channels are multiplexed in said frequency multiplexer, each one of the plurality of frequency channels provided to a respective one of the plurality of input/output ports, wherein for a minimum frequency and a maximum frequency of said plurality of frequency channels, the first respective resonator is disposed distally from respective input/output ports for the channel and wherein for a first middle frequency and a second middle frequency of said plurality of frequency channels, the first respective resonator is disposed close to the respective input/output ports when compared to the first respective resonators for the minimum frequency and the maximum frequency.

10. The frequency multiplexer of claim 8 wherein each of the air-filled resonators further includes a dielectric resonator.

11. The frequency multiplexer of claim 5, said multiplexer multiplexing four frequency channels.

12. The frequency multiplexer of claim 9, said multiplexer further comprising, for the maximum frequency and the minimum frequency, first and second transmission lines running from the first respective resonators for the maximum frequency and the minimum frequency to the respective input/output ports for the maximum frequency and the minimum frequency.

13. The frequency multiplexer of claim 12, wherein for said first middle frequency and said second middle frequency, the respective input/output ports are directly connected to the first respective resonators for the first middle frequency and the second middle frequency.

14. The multi-channel frequency multiplexer according to claim 13, wherein said multiplexer is part of CDMA communication system.

15. The multi-channel frequency multiplexer according to claim 5, wherein said multiplexer is part of CDMA communication system.

16. The multi-channel frequency multiplexer according to claim 9, wherein said multiplexer is part of CDMA communication system.

17. The multi-channel frequency multiplexer according to claim 1, further comprising a plurality of input/output ports connected to respective first resonators of said N×N matrix, wherein a plurality of frequency channels are multiplexed in said frequency multiplexer, each one of the plurality of frequency channels provided to a respective one of the plurality of input/output ports, wherein for a minimum frequency and a maximum frequency of said plurality of channels, the respective first resonator is disposed distally from respective input/output ports for the channel and wherein for a first middle frequency and a second middle frequency of said plurality of frequency channels, the respective first resonator is disposed close to the respective input/output ports when compared to the respective first resonators for the minimum and maximum frequency.

18. The frequency multiplexer of claim 17, said multiplexer further comprising for the maximum frequency and the minimum frequency, first and second transmission lines running from the respective first resonators to the respective input/output ports for the maximum frequency and the minimum frequency.

19. The frequency multiplexer of claim 18, wherein for said first middle frequency and said second middle frequency, the respective input/output ports are directly connected to the respective first resonators for the first middle frequency and the second middle frequency.

20. The multi-channel frequency multiplexer according to claim 19, wherein said multiplexer is part of CDMA communication system.

21. The frequency multiplexer of claim 5, wherein a plurality of frequency channels are multiplexed in said frequency multiplexer, each one of the plurality of frequency channels provided to a respective one of the plurality of input/output ports, wherein for a minimum frequency and a maximum frequency of said plurality of frequency channels, a respective first resonator is disposed distally from respective input/output ports for the channel and wherein for a first middle frequency and a second middle frequency of said plurality of frequency channels, a respective first resonator is disposed close to the respective input/output ports when compared to the respective first resonators for the minimum and maximum frequency.

22. The frequency multiplexer of claim 21, said multiplexer further comprising, for the maximum frequency and the minimum frequency, first and second transmission lines running from the respective first resonators to the respective input/output ports for the maximum frequency and the minimum frequency.

23. The frequency multiplexer of claim 22, wherein for said first middle frequency and said second middle frequency, the respective input/output ports are directly connected to respective first resonators for the first middle frequency and the second middle frequency.

24. The multi-channel frequency multiplexer according to claim 23, wherein said multiplexer is part of CDMA communication system.

25. The multi-channel frequency multiplexer according to claim 1, further comprising a plurality of input/output ports connected to respective first resonators of said N×N matrix, wherein the respective first resonator for each input/output port is disposed along one side wall of the common resonator.

26. The multi-channel frequency multiplexer according to claim 25, wherein each of said respective first resonators connected to respective input/output ports is further connected to a respective second resonator, each of said respective second resonators being provided at a corner position of the N×N matrix.

27. The multi-channel frequency multiplexer according to claim 26, wherein a plurality of frequency channels are multiplexed in said frequency multiplexer, each one of the plurality of frequency channels provided to a respective one of the plurality of input/output ports, wherein for a minimum frequency and a maximum frequency of said plurality of frequency channels, the respective first resonator is disposed distally from respective input/output ports for the channel and wherein for a first middle frequency and a second middle frequency of said plurality of frequency channels, the respective first resonator is disposed close to the respective input/output ports when compared to the respective first resonators for the minimum and maximum frequency.

28. The multi-channel frequency multiplexer according to claim 26, wherein said multiplexer is part of a CDMA communication system.

29. The multi-channel frequency multiplexer according to claim 27, wherein said multiplexer is part of CDMA communication system.

30. A method for multiplexing a plurality of frequency channels comprising:

for each of the plurality of frequency channels, resonating a respective channel signal in respective first and second resonators; and for each channel signal of said plurality of frequency channels, resonating the channel signal in a common resonator, wherein the common resonator is disposed as a central resonator in a matrix of resonators, wherein said matrix comprises an N×N matrix, where $N \geqq 3$.

31. The method of claim 30, said method further comprising: for a minimum and maximum frequency of said plurality of frequency channels, transmitting the respective channel signal to the respective first resonator over a transmission line, and for a first middle frequency and a second middle frequency of said plurality of frequency channels, providing the respective channel signal directly to the respective first resonator through respective input/output ports for the first middle frequency and the second middle frequency.

32. The method according to claim 31, wherein resonating in the first and second resonators comprises resonating the channel signals in air-filled cavities.

33. The method according to claim 32, wherein resonating in the first and second resonators comprises resonating the channel signals using a dielectric.

34. A method for multiplexing a plurality of frequency channels comprising:

for each of the plurality of frequency channels, resonating a respective channel signal in respective first and second resonators; and for each channel signal of said plurality of frequency channels, resonating the channel signal in a common resonator, wherein the common resonator is disposed as a central resonator in a matrix of resonators, wherein the central resonator is disposed at a position away from edge portions of the matrix.

* * * * *